United States Patent [19]

Tsubata

[11] 4,020,621

[45] May 3, 1977

[54] METHOD OF AND APPARATUS FOR ENDING THE BROKEN YARN IN AN OPEN-END SPINNING SYSTEM

[75] Inventor: Kazuo Tsubata, Kyotoshi, Japan

[73] Assignee: Hironori Hirai, Nagaokakyoshi, Japan

[22] Filed: Sept. 26, 1974

[21] Appl. No.: 509,455

[30] Foreign Application Priority Data

July 29, 1973 Japan ..... 48-109712

[52] U.S. Cl. ..... 57/34 R; 57/22; 57/58.89; 57/156; 192/84 A; 57/81

[51] Int. Cl.[2] ..... D01H 15/00; D01H 13/18; F16D 67/06

[58] Field of Search ..... 57/34 R, 22, 58.89–58.95, 57/81, 159, 78, 80, 83, 85, 90, 156; 192/84 A, 84 B, 84 C

[56] References Cited

UNITED STATES PATENTS

| | | | |
|---|---|---|---|
| 3,354,626 | 11/1967 | Cizek et al. | 57/58.89 X |
| 3,501,905 | 3/1970 | Landwehrkamp et al. | 57/83 X |
| 3,541,774 | 11/1970 | Sterba et al. | 57/58.89 X |
| 3,601,969 | 8/1971 | Susami et al. | 57/58.89 X |
| 3,680,300 | 8/1972 | Landwehrkamp | 57/34 R |
| 3,687,252 | 8/1972 | Krull | 192/84 A X |
| 3,734,256 | 5/1973 | Compton | 192/84 A |
| 3,782,089 | 1/1974 | Landwehrkamp et al. | 57/58.95 X |
| 3,791,128 | 2/1974 | Landwehrkamp et al. | 57/58.89 X |
| 3,803,823 | 4/1974 | Niestroj et al. | 57/34 R |

*Primary Examiner*—Donald Watkins
*Attorney, Agent, or Firm*—Whittemore, Hulbert & Belknap

[57] ABSTRACT

A method of and apparatus for piecing up the broken yarn in an open end spinning machine wherein the yarn breakage that has occurred in a spinning unit of the machine is pieced up or jointed with the fiber material supplied into a rotor while the spinning unit is operated at the ordinary high spinning speed and while the various elements of the spinning unit are driven at the same speed as the high spinning speed.

22 Claims, 4 Drawing Figures

METHOD OF AND APPARATUS FOR ENDING THE BROKEN YARN IN AN OPEN-END SPINNING SYSTEM

BACKGROUND OF THE INVENTION

This invention relates to a method of and an apparatus for piecing up the broken yarn in an open-end spinning system.

Heretofore, in the open-end spinning system, the operation of piecing up the broken yarn could be accomplished up to about 30,000 r.p.m. of the rotor without the necessity of making any special contrivance. However, the rate of success in piecing up the broken yarn was generally low for high speed rotation of say about 50,000 to 60,000 r.p.m. of the rotor, because the setting of the correct timing for supplying the separate fiber material for piecing up with the broken yarn or the supply quantity thereof and that of the correct timing for starting the winding operation or withdrawal of the piecing up yarn from the rotor will become progressively difficult with increase in the number of revolutions of the rotor. To cope with such difficulties, the number of revolutions of the rotor had to be reduced to say about 30,000 r.p. m. for performing the yarn piecing up operation. In such a case, not only the production efficiency was lowered due to the reduced speed of rotation of the rotor but the spinning unit assembly was generally complicated in its structure because of the annexed variable speed devices and sensing devices for the rotational speed of the rotor.

SUMMARY OF THE INVENTION

When a yarn end is thrown into the inside of a revolving rotor for piecing up, it is twisted under the effect of a centifugal force and thus reduced in length. At this time, some tension is produced on the yarn end. According to the present invention, this phenomenon is utilized advantageously so that such tension on the yarn end is sensed by a sensor or a feeler and the delivery of the separated fiber material into the rotor is started depending on the output of the sensor.

The winding operation or withdrawal of the pieced up yarn from the rotor is started after a predetermined time as set on a timer has elapsed since the start of delivery of the separated fibers, or as a sensor or feeler has sensed that the tension on the end yarn has increased with the progress of delivery of the separated fiber material and attained a predetermined value.

According to the present invention, the percentage of successful yarn piecing up operation may be improved drastically, and the yarn piecing up operation can be performed with the spinning system running at its elevated speed, without it being necessary to lower the rotational speed of the rotor for yarn piecing up. According to the experiment conducted by the applicant with the use of cotton yarn, of which diameter is 0.012–0.70 inch, the rate of successful yarn piecing up operation has attained nearly 100% for 50,000 r.p.m. of the rotor and exceeded 80% for 60,000 r.p.m. of the rotor. Moreover, the separated fiber material can be supplied in an optimum quantity, and the pieced up portion of the yarn may be twisted satisfactorily and have a smooth appearance. In the conventional open-end spinning machine, the pieced up portion is generally thicker by more than 400% than the remaining portion of the yarn. In accordance with present invention, the bulging rate of the pieced up yarn portion can be reduced to less than 200%, thus making it possible to dispense with the step of unwinding the yarn by using a winder so as to remove the bulged portion from the yarn. Moreover, the present apparatus is simple and inexpensive because each spinning unit is provided with separate feed clutch and take-up clutch means. The electrical circuit and the timer are also inexpensive. The apparatus can be made more simple in structure and inexpensive by providing a single set of the electrical circuit and the timer for a group of spinning units. In addition, according to the present invention, the delivery of the separated fiber material and the restart of the winding operation can be accomplished automatically if only the proper timer setting is made in advance and the yarn end is, pulled out from the winding package and thrown into a guide pipe at the time of breakage of the yarn.

While the method of the present invention described above provides a pieced up portion of even thickness and smooth appearance, a second electrical signal to be described later may occasionally be produced from the yarn tension sensor in case the sufficient quantity of the fiber material is not supplied into the rotor but the yarn end portion YF is given a sufficient twist, or the separated fiber material are supplied in an excess quantity and yet the sufficient twist is not given to the yarn end portion. In this instance, the spinning unit may be so constructed that the winding operation is started after lapse of time set on the timer and after transmission of the second signal from the yarn tension sensor. The rate of successful yarn piecing up operation can then be increased further, the pieced up portion will have an improved appearance and more uniform thickness.

According to a further feature of the present invention, the separated fiber material can be supplied in a controlled quantity during the normal winding of spun yarn, owing to the provision of the yarn tension sensing means in a control unit for controlling the number of revolutions of the feed roller. When the quantity of the separated fibers is changed during the normal winding operation for some reason, the resistance offered by the yarn being intertwined with the fiber material is also changed, resulting in the fluctuations in the yarn tension. These fluctuations are sensed by the yarn tension sensor for changing the number of revolutions of the feed roller so as to adjust the supply of the fiber material to effect more uniform spinning.

DETAILED DESCRIPTION OF THE INVENTION

Figure 1:
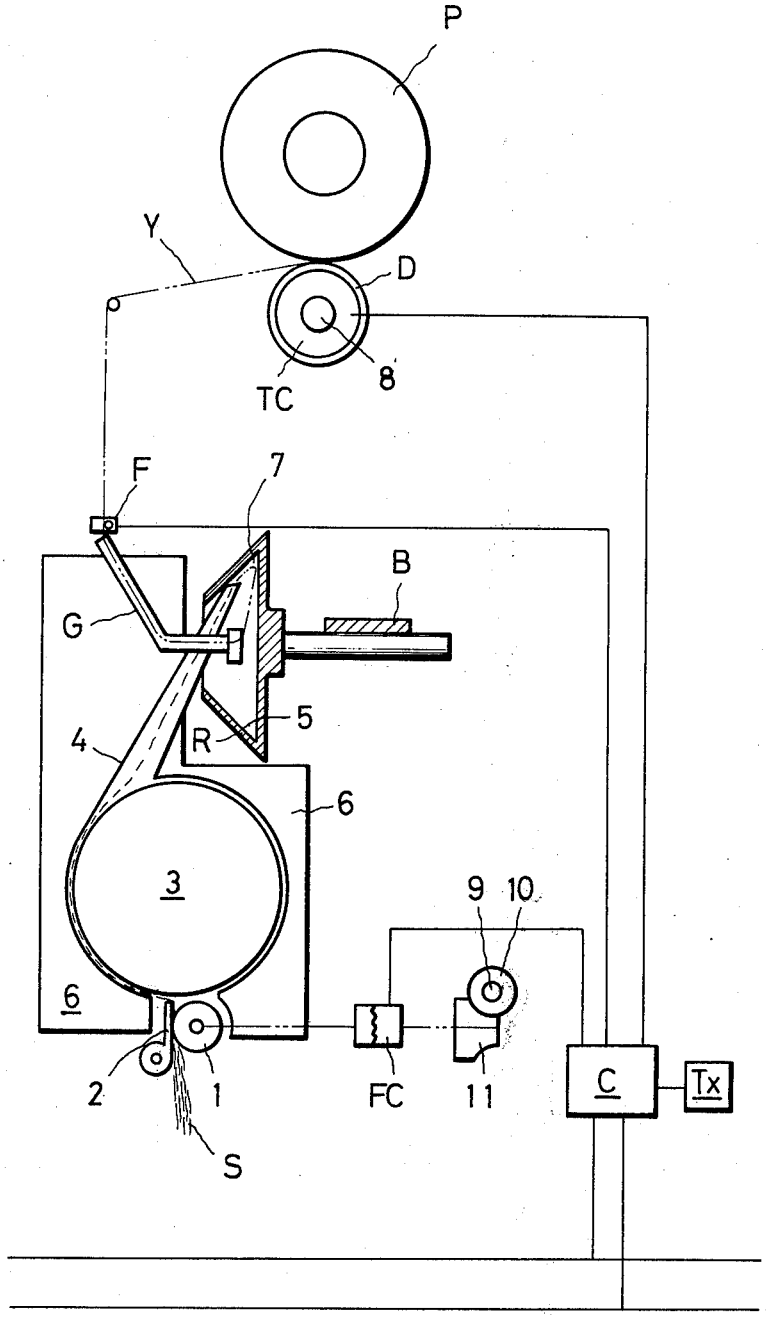
FIG. 1 is an explanatory view of a spinning unit including the present apparatus.

Referring to FIG. 1, C designates an electric circuit connected to a timer TX. Although each spinning unit is provided with one such circuit C and timer TX in FIG. 1 for ease of understanding, plural spinning units may be arranged into one group and associated with one circuit C and timer TX for economy sake. This electric circuit C is further connected electrically with a yarn breakage sensor or feeler F, a sliver feed clutch FC and a take-up clutch TC enclosed in a winding drum D.

The yarn breakage feeler F is designed to sense the tension applied to the yarn as conventionally so as to make or break an electrical contact included in the circuit, and is mounted intermediate a winding package P and a rotor R.

The sliver S is pinched between a feed roller 1 and a pressure plate 2 and supplied into an opening unit 6 where it is opened by the rotating opening roller 3 into one or more separate fibers. These separate fibers are carried by an air stream through a channel insert 4 into the inside of a rotor R where they are blown towards and transferred on the receiving surface 5 under the effect of a gyrating air current in the revolving rotor R. And then the fibers are collected on the collecting surface 7 under the effect of centrifugal force upon the rotation of the rotor R.

A feed shaft 9 is mounted in common to the group of spinning units longitudinally of the machine frame and adapted to drive a feed roller through a worm 10, a helical gear 11 and the feed clutch FC. A transmission belt B is mounted in common to the group of spinning units and adapted to drive the rotor R into rotation.

The fibers collected on the collecting surface 7 are twisted into a yarn Y and delivered through a guide pipe G and wound on the package P rotated by frictional contact with the winding drum D.

The winding drum D is mounted to each spinning unit and fitted to a drum shaft 8 mounted in common to the group of the spinning units longitudinally of the machine frame. The take-up clutch TC is mounted inside the winding drum D as an electromagnetically operated clutch brake means and operates to establish or interrupt the driving connection between the drum shaft 8 and the winding drum D.

The device operates as follows: When the feeler F senses the yarn breakage in a spinning unit, the electrical contact is turned off to disengage the feed clutch FC and the take-up clutch TC. Thus the feed roller 1 and the winding package P of the spinning unit are immediately brought to a stop.

When piecing up the broken yarn, the end of the yarn wound on the package is thrown as a yarn end into the inside of the rotor R manually or by a device designed to hold or release the yarn in a freely suspended position. The yarn end charged into the rotor R is revolved therewith and placed under a tension under the centrifugal force and the shrinkage in length of the yarn caused by twisting. This tension is sensed by the feeler F which acts immediately to engage the feed clutch FC, thereby driving the feed roller 1 into rotation so as to supply the fibers into the rotor.

These fibers are accummulated uniformly on the inner wall surface 7 of the rotor R. At this time, the yarn end is secured fixedly at the winding side and placed flat at the other side on the inner wall 7 of the rotor and revolved together with the rotor. The yarn end is twisted as a result and the end part of the yarn is rotated about its axis. The yarn end is now interwined with the free ends of the fibers about to be heaped on the wall 7 of the rotor. The twisting movement is transmitted to the thicker fiber bundle already heaped on the inner wall 7 of the rotor. When the fibers are supplied into the rotor in a sufficient quantity to be intertwined with the end yarn for piecing up, and the yarn continuous to the ended portion becomes thicker and twisted to the required degree, the yarn is lifted as spun yarn endowed with sufficient strength, and the spinning operation is started again. According to the present embodiment, the optimum time interval To since the injection of the fibers into the rotor until the taking up of the pieced up yarn is set on the timing relay TX. Thus, after lapse of this time interval To since the start of injection of the separated fibers, the take-up clutch TC is engaged to drive the winding package P into rotation so as to wind up the yarn.

Figure 2:
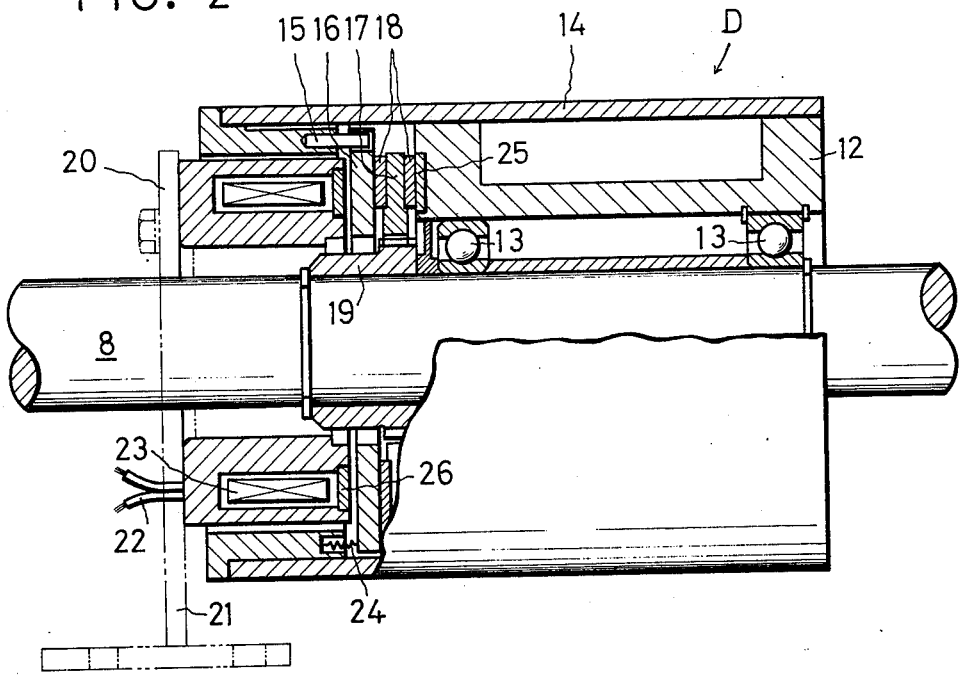
FIG. 2 is a front sectional view of the traverse drum.

Referring to FIG. 2 showing an embodiment of the take-up clutch, the numeral 12 denotes a drum body mounted on the drum shaft 8 by means of a bearing 13, the numeral 14 a drum tube secured to the drum body 12, the numeral 15 a pin secured to the drum tube 14 and to which an armature 16 is fitted axially slidably on a splined shaft 19 secured in turn to the drum shaft 8, and the numeral 20 a coil casing secured to a fixed bracket 21 and enclosing a coil 23 connected to leads 22. When the current is not supplied to the leads 22, the armature 16 is biased towards right in the drawing under the force of the spring 24 and the disc 17 fitted on both sides with the linings 18 is clinched by and between the armature 16 and a friction surface 25 provided to the drum body. At this time, the drum body 12 is united as one with the disc 17 and revolved with rotation of the drum shaft 8. When the current is supplied to the leads 22, the oil 23 is energized and the armature 16 is displaced towards left in the drawing. Thus, the connection between the drum body 12 and the drum shaft 8 is interrupted, at the same time that the armature 16 is pressed onto a brake shoe 26 of the coil casing 20 for braking the drum body 12. The take-up clutch thus operates to start or stop the rotation of the drum body 12 immediately according as the current is applied to the leads 22 or not.

In the present embodiment, rotation or cessation of rotation of the drum is transmitted to the package P. In the modified embodiment wherein the package is supported on a pivotally movable cradle and designed to be contacted with and displaced away from the drum surface, the take-up clutch way be omitted and a solenoid may be provided in the electric circuit C to effect the pivotal displacement of the cradle.

In the preceding embodiment, the feeler F adapted to sense the occurrence of the yarn breakage and to stop the feed roller and the winding package is used at the same time for sensing the tension placed on the end yarn. In the modified embodiment shown in FIG. 3, a separate sensing means is provided for sensing the end yarn tension for controlling the time of supplying the separated fibers and starting the wind-up operation.

Figure 3:
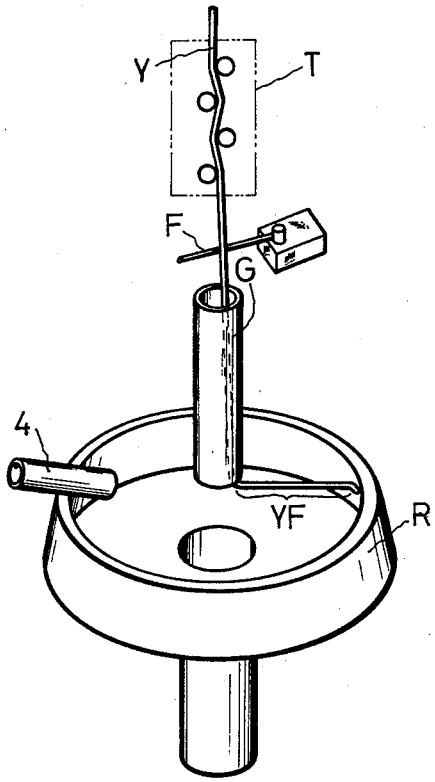
FIG. 3 is a perspective view of a rotor including a yarn tension sensor and a yarn breakage sensing rotor.

Referring to FIG. 3 showing this modified embodiment, the fibers are introduced into th rotor R through a supply conduit 4, and taken out from the rotor R in the form of spun yarn through a guide pipe G. The yarn breakage feeler F and a yarn sensor T are mounted at the exit side and towards the winding package not shown in FIG. 3. The feed roller and the winding package, also not shown in FIG. 3, are adapted to be driven into rotation or stopped in the same way as in the preceding embodiment. The yarn tension sensor may be of the electrically operated type and designed as conventionally so that the electrical current or voltage may be generated in varying intensity depending on the sensed yarn tension.

When piecing up the broken yarn, the yarn end is thrown into the guide pipe G by way of the yarn tension sensor T and the yarn breakage feeler F. When thrown into the guide pipe, the yarn end is twisted by rotation of the rotor R. The yarn end portion YF intermediate the lower end of the guide pipe G and the inner wall of the rotor is shrunk in length as a result of twisting, and the increasing tension is placed on the yarn end as a whole. The amount of twist given to the yarn end may thus be known from the measured tension on the yarn end. According to the present embodiment, a first electrical signal is produced by the yarn tension sensor as the yarn end tension has reached a proper value for intertwining the yarn end with the free end of the fiber to be supplied subsequently into the rotor, and the feed clutch FE is engaged upon reception of this first signal to start the delivery of the separated fibers into the rotor.

As the fibers are intertwined with the free end of the yarn end, the tension placed on the yarn end is increased further due to the resistance offered by the intertwined fibers. According to the present embodiment, a second electrical signal is generated as the yarn end tension has reached a proper value such that the yarn end is intertwined with the fiber ends to the optimum degree and the pieced up portion has become tolerably thick, and the take-up clutch TC is engaged upon reception of this second signal to start the winding operation.

In these two embodiments, when piecing up the yarn at the number of revolution of the rotor and that of the feed roller commonly employed for spinning, the time interval necessary for twisting the yarn to the optimum degree for the subsequent yarn piecing up tends to be shorter than that required for feeding the fibers in an optimum quantity for piecing up.

For instance, it was observed experimentally that, when spinning the cotton yarn, of which diameter is 0.0121 inch, at a 40,000 r.p.m. of the rotor, the optimum time for twisting the yarn end was approximately 0.4 second, while the proper time interval for feeding the separated fibers was approximately 0.2 second.

Figure 4:
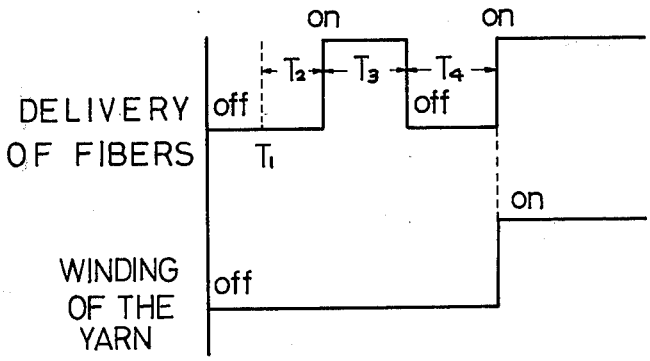
FIG. 4 is a diagram showing the timing relationship between the delivery of the fibers and the winding of the spun yarn.

In such a case, as shown in FIG. 4, the feed clutch FC is engaged after lapse of a time interval $T_2$ since the time $T_1$ at which the yarn end is thrown into the rotor. Then, after lapse of a time interval $T_3$ since the charging of the end yarn, the feed clutch FC is disengaged. Then, the take-up clutch TC as well as the feed clutch FC is engaged after the lapse of a time interval $T_4$ since the disengagement of the feed clutch TC to start the winding operation.

What is claimed is:

1. A method for piecing up broken yarn ends in an open-end spinning machine including a rotor, feed means for feeding separated fibers to the rotor and take-up means for removing spun yarn from the rotor, comprising sensing the tension in the taken up yarn to determine yarn breakage, stopping the feed means and take-up means on sensing a broken yarn end, placing the broken yarn end in the still rotating rotor, subsequently delivering separated fibers to the rotor in response to tension on the broken yarn end reaching a desired value and then taking out pieced up spun yarn from the rotor a predetermined time after delivery of the separated fibers to the rotor

2. The method as set forth in claim 1, wherein the introduction of separated fibers into the rotor is stopped prior to the taking out of the pieced up spun yarn from the rotor and started again with the starting of the taking out of the pieced up yarn.

3. Apparatus for piecing up broken yarn ends in an open-end spinning machine including a rotor, means for feeding separated fibers to the rotor and means for withdrawing spun yarn from the rotor, comprising a feed clutch operable to start and stop feeding of separate fibers to the rotor, a winding drum having a take-up clutch associated therewith operable to start and stop taking out of spun yarn from the rotor, at least one tension sensing means for sensing the tension in the yarn taken out of the rotor, a timer for timing intervals since insertion of a broken yarn end into the rotor and an electric circuit for receiving signals from the tension sensing means and the timer and for providing control signals to the feed clutch and take-up clutch, whereby on sensing tension in the yarn taken out of the rotor indicating a broken yarn end, the feed clutch and take-up clutch are disengaged to prevent feeding of separated fibers to the rotor and taking out of spun yarn from the rotor and on sensing of a predetermined tension in the broken yarn end after reinsertion of the broken yarn end into the rotor, the feed clutch is actuated to pass separated fibers into the rotor and subsequently on sensing of additional tension in the yarn end fed into the rotor, the take-up clutch is actuated to take pieced-up spun yarn out of the rotor.

4. Structure as set forth in claim 3, wherein two separate means are provided for sensing tension in the yarn being removed from the rotor whereby initial breakage of the yarn and tension in the reinserted broken yarn end are sensed separately.

5. Structure as set forth in claim 3, wherein the take-up clutch comprises a drum body rotatably mounted on a drum shaft, a drum tube secured to the drum body for rotation therewith, an electrically actuated solenoid secured in a fixed position at one end of the brake drum, an annular armature mounted on the drum shaft for axial movement relative thereto on actuation of the solenoid and engaged with the drum tube for rotation therewith, a clutch disc secured to the drum shaft for rotation therewith and axial movement therealong having friction plates on both sides thereof between the one end of the drum body and the armature, resilient means biasing the armature into engagement with a friction surface on one side of the clutch disc urging the friction plate on the other side of the clutch disc into engagement with a friction surface on the one end of the drum to effectively engage the drum body with the drum shaft with the solenoid unactuated, and fixed friction means at the opposite side of the armature between the drum body and solenoid for stopping rotation of the armature, drum tube and drum body on actuation of the solenoid to cause disengagement of the armature and drum body from the clutch disc.

6. Take-up clutch structure comprising a drum body rotatably mounted on a drum shaft, a drum tube secured to the drum body for rotation therewith, an electrically actuated solenoid secured in a fixed position at one end of the brake drum, an annular armature mounted on the drum shaft for axial movement relative thereto on actuation of the solenoid and engaged with the drum tube for rotation therewith, a clutch disc secured to the drum shaft for rotation therewith and axial movement therealong having friction plates on both sides thereof between the one end of the drum body and the armature, resilient means biasing the armature into engagement with a friction surface on one side of the clutch disc urging the friction plate on the other side of the clutch disc into engagement with a friction surface on the one end of the drum to effectively engage the drum body with the drum shaft with the solenoid unactuated, and fixed friction means at the opposite side of the armature between the drum body and solenoid for stopping rotation of the armature, drum tube and drum body on actuation of the solenoid to cause disengagement of the armature and drum body from the clutch disc.

7. A method for piecing up broken yarn ends in an open-end spinning machine including a rotor, feed means for feeding separated fibers to the rotor and take-up means for removing spun yarn from the rotor, comprising sensing the tension in the taken up yarn to determine yarn breakage, stopping the feed means and take-up means on sensing a broken yarn end, placing the broken yarn end in the still rotating rotor, subsequently delivering separated fibers to the rotor in response to a predetermined time lapse since the introduction of broken yarn end into the rotor, and then taking out pieced up spun yarn from the rotor a predetermined time after introduction of the broken yarn end into the rotor.

8. The method as set forth in claim 7, wherein the introduction of separated fibers into the rotor is stopped prior to the taking out of the pieced up spun yarn from the rotor and started again with the starting of the taking out of the pieced up yarn.

9. A method for piecing up broken yarn ends in an open-end spinning machine including a rotor, feed means for feeding separated fibers to the rotor and take-up means for removing spun yarn from the rotor, comprising sensing the tension in the taken up yarn to determine yarn breakage, stopping the feed means and take-up means on sensing a broken yarn end, placing the broken yarn end in the still rotating rotor, subsequently delivering separated fibers to the rotor in response to tension on the yarn end reaching a desired value and then taking out pieced up spun yarn from the rotor a predetermined time after introduction of the broken yarn end into the rotor.

10. The method as set forth in claim 9, wherein the introduction of separated fibers into the rotor is stopped prior to the taking out of the pieced up spun yarn from the rotor and started again with the starting of the taking out of the pieced up yarn.

11. A method for piecing up broken yarn ends in an open-end spinning machine including a rotor, feed means for feeding separated fibers to the rotor and take-up means for removing spun yarn from the rotor, comprising sensing the tension in the taken up yarn to determine yarn breakage, stopping the feed means and take-up means on sensing a broken yarn end, placing the broken yarn end in the still rotating rotor, subsequently delivering separated fibers to the rotor a predetermined time since the introduction of the broken yarn end into the rotor and then taking out pieced up spun yarn from the rotor in response to a predetermined tension in the yarn end.

12. The method as set forth in claim 11, wherein the introduction of separated fibers into the rotor is stopped prior to the taking out of the pieced up spun yarn from the rotor and started again with the starting of the taking out of the pieced up yarn.

13. Apparatus for piecing up broken yarn ends in an open-end spinning machine including a rotor, means for feeding separated fibers to the rotor and means for withdrawing spun yarn from the rotor, comprising a feed clutch operable to start and stop feeding of separate fibers to the rotor, a winding drum having a take-up clutch associated therewith operable to start and stop taking out of spun yarn from the rotor, at least one tension sensing means for sensing the tension in the yarn taken out of the rotor, a timer for timing intervals since insertion of a broken yarn end into the rotor and an electric circuit for receiving signals from the tension sensing means and the timer and for providing control signals to the feed clutch and take-up clutch, whereby on sensing tension in the yarn taken out of the rotor indicating a broken yarn end, the feed clutch and take-up clutch are disengaged to prevent feeding of separated fibers to the rotor and taking out of spun yarn from the rotor and on sensing of a predetermined tension after insertion of the broken yarn end into the rotor, the feed clutch is actuated to pass separated fibers into the rotor, and subsequently on sensing of additional tension in the yarn end fed into the rotor, the take-up clutch is actuated to take pieced up spun yarn out of the rotor.

14. Structure as set forth in claim 13, wherein two separate means are provided for sensing tension in the yarn being removed from the rotor whereby initial breakage of the yarn and tension in the reinserted broken yarn end are sensed separately.

15. Structure as set forth in claim 13, wherein the take-up clutch comprises a drum body rotatably mounted on a drum shaft, a drum tube secured to the drum body for rotation therewith, an electrically actuated solenoid secured in a fixed position at one end of the brake drum, an annular armature mounted on the drum shaft for axial movement relative thereto on actuation of the solenoid and engaged with the drum tube for rotation therewith, a clutch disc secured to the drum shaft for rotation therewith and axial movement therealong having friction plates on both sides thereof between the one end of the drum body and the armature, resilient means biasing the armature into engagement with a friction surface on one side of the clutch disc urging the friction plate on the other side of the clutch disc into engagement with a friction surface on the one end of the drum to effectively engage the drum body with the drum shaft with the solenoid unactuated, and fixed friction means at the opposite side of the armature between the drum body and solenoid for stopping rotation of the armature, drum tube and drum body on actuation of the solenoid to cause disengagement of the armature and drum body from the clutch disc.

16. Apparatus for piecing up broken yarn ends in an open-end spinning machine including a rotor, means for feeding separated fibers to the rotor and means for withdrawing spun yarn from the rotor, comprising a feed clutch operable to start and stop feeding of separate fibers to the rotor, a winding drum having a take-up clutch associated therewith operable to start and stop taking out of spun yarn from the rotor, at least one tension sensing means for sensing the tension in the yarn taken out of the rotor, a timer for timing intervals since insertion of a broken yarn end into the rotor and an electric circuit for receiving signals from the tension sensing means and the timer and for providing control signals to the feed clutch and take-up clutch, whereby on sensing tension in the yarn taken out of the rotor indicating a broken yarn end, the feed clutch and take-up clutch are disengaged to prevent feeding of separated fibers to the rotor and taking out of spun yarn from the rotor and on sensing a predetermined tension in the broken yarn end after reinsertion of the broken yarn end into the rotor, the feed clutch is actuated to pass separated fibers into the rotor, and subsequently on sensing of a further time after insertion of the yarn end into the rotor, the take-up clutch is actuated to take pieced up spun yarn out of the rotor.

17. Structure as set forth in claim 16, wherein two separate means are provided for sensing tension in the yarn being removed from the rotor whereby initial breakage of the yarn and tension in the reinserted broken yarn end are sensed separately.

18. Structure as set forth in claim 16, wherein the take-up clutch comprises a drum body rotatably mounted on a drum shaft, a drum tube secured to the drum body for rotation therewith, an electrically actuated solenoid secured in a fixed position at one end of the brake drum, an annular armature mounted on the drum shaft for axial movement relative thereto on actuation of the solenoid and engaged with the drum tube for rotation therewith, a clutch disc secured to the drum shaft for rotation therewith and axial movement therealong having friction plates on both sides thereof between the one end of the drum body and the armature, resilient means biasing the armature into engagement with a friction surface on one side of the clutch disc urging the friction plate on the other side of the clutch disc into engagement with a friction surface on the one end of the drum to effectively engage the drum body with the drum shaft with the solenoid unactuated, the fixed friction means at the opposite side of the armature between the drum body and solenoid for stopping rotation of the armature, drum tube and drum body on actuation of the solenoid to cause disengagement of the armature and drum body from the clutch disc.

19. Apparatus for piecing up broken yarn ends in an open-end spinning machine including a rotor, means for feeding separated fibers to the rotor and means for withdrawing spun yarn from the rotor, comprising a feed clutch operable to start and stop feeding of separate fibers to the rotor, a winding drum having a take-up clutch associated therewith operable to start and stop taking out of spun yarn from the rotor, at least one tension sensing means for sensing the tension in the yarn taken out of the rotor, a timer for timing intervals since insertion of a broken yarn end into the rotor and an electric circuit for receiving signals from the tension sensing means and the timer and for providing control signals to the feed clutch and take-up clutch, whereby on sensing tension in the yarn taken out of the rotor indicating a broken yarn end, the feed clutch and take-up clutch are disengaged to prevent feeding of separated fibers to the rotor and taking out of spun yarn from the rotor and on sensing of a predetermined time after insertion of the broken yarn end into the rotor, the feed clutch is actuated to pass separated fibers into the rotor, and subsequently on sensing of a further time after insertion of the yarn end into the rotor, the take-up clutch is actuated to take up pieced up spun yarn out of the rotor.

20. Structure as set forth in claim 19, wherein two separate means are provided for sensing tension in the yarn being removed from the rotor whereby initial breakage of the yarn and tension in the reinserted broken yarn end are sensed separately.

21. Structure as set forth in claim 19, wherein the take-up clutch comprises a drum body rotatably mounted on a drum shaft, a drum tube secured to the drum body for rotation therewith, an electrically actuated solenoid secured in a fixed position at one end of the brake drum, an annular armature mounted on the drum shaft for axial movement relative thereto on actuation of the solenoid and engaged with the drum tube for rotation therewith, a clutch disc secured to the drum shaft for rotation therewith and axial movement therealong having friction plates on both sides thereof between the one end of the drum body and the armature, resilient means biasing the armature into engagement with a friction surface on one side of the clutch disc urging the friction plate on the other side of the clutch disc into engagement with a friction surface on the one end of the drum to effectively engage the drum body with the drum shaft with the solenoid unactuated, and fixed friction means at the opposite side of the armature between the drum body and solenoid for stopping rotation of the armature, drum tube and drum body on actuation of the solenoid to cause disengagement of the armature and drum body from the clutch disc.

22. A method for piecing up broken yarn ends in an open-end spinning machine including a rotor, feed means for feeding separated fibers to the rotor, a yarn tension sensor for and take-up means for removing spun yarn from the rotor, comprising introducing the yarn end into the rotor, generating a first yarn tension signal in the yarn tension sensor on introduction of the yarn end into the rotor, feeding the separate fibers into the rotor on generation of the first yarn tension signal in the yarn tension sensor, stopping the feeding of fibers after a predetermined time for a predetermined time before the start of the take-up means, restarting said feeding of fibers in response to a second signal from said yarn end tension sensor, which is generated as the yarn end tension reaches an optimum tension and starting the take up means in response to the second signal from the yarn end sensor to start the wind up operation.

* * * * *